United States Patent [19]

Kusumoto et al.

[11] Patent Number: 4,949,124

[45] Date of Patent: Aug. 14, 1990

[54] IMAGE FORMING APPARATUS HAVING PLURAL DEVELOPING UNITS AND AN ARRANGEMENT FOR SELECTING THE DEVELOPING UNIT HAVING THE HIGHEST USE COUNT

[75] Inventors: Keiji Kusumoto; Masazumi Ito; Yoshiaki Takano; Takashi Noda, all of Osaka, Japan

[73] Assignee: Minolta Camera Kabushiki Kaisha, Osaka, Japan

[21] Appl. No.: 203,158

[22] Filed: Jun. 7, 1988

[30] Foreign Application Priority Data

Jun. 8, 1987 [JP] Japan ..... 62-142932

[51] Int. Cl.[5] ..... G03G 15/00; G03G 15/01

[52] U.S. Cl. ..... 355/203; 355/326; 355/245

[58] Field of Search ..... 355/203, 204–206, 355/208, 308, 309, 326, 245, 260; 364/550

[56] References Cited

U.S. PATENT DOCUMENTS

| | | | |
|---|---|---|---|
| 3,886,329 | 5/1975 | Kamiyama | 355/308 X |
| 3,960,445 | 6/1976 | Drawe . | |
| 4,222,660 | 9/1980 | Furuichi et al. . | |
| 4,416,533 | 11/1983 | Tokunaga et al. . | |
| 4,453,821 | 6/1984 | Smith | 355/204 X |
| 4,496,237 | 1/1985 | Schron | 364/550 X |
| 4,634,258 | 1/1987 | Tanaka et al. . | |
| 4,720,730 | 1/1988 | Ito . | |

FOREIGN PATENT DOCUMENTS

| | | | |
|---|---|---|---|
| 60-230168 | 11/1985 | Japan . | |
| 61-73974 | 4/1986 | Japan | 355/208 |
| 61-117576 | 6/1986 | Japan | 355/326 |

*Primary Examiner*—Joan H. Pendegrass

*Attorney, Agent, or Firm*—Burns, Doane, Swecker & Mathis

[57] ABSTRACT

An image forming apparatus has plural developing units which perform image forming operations with use of either one of the developing units.

The image forming apparatus includes a counting arrangement for counting a respective number of times of use of the plural developing units or with respect to each of the colors of developers contained in the plural developing units. A developing unit is selected having the highest frequency in use among the developing units when the image forming apparatus is brought into the initial mode thereof.

20 Claims, 7 Drawing Sheets

IMAGE FORMING APPARATUS HAVING PLURAL DEVELOPING UNITS AND AN ARRANGEMENT FOR SELECTING THE DEVELOPING UNIT HAVING THE HIGHEST USE COUNT

BACKGROUND OF THE INVENTION

1. Field of the Invention

The present invention relates to an image forming apparatus such as a copy machine, a printer or the like which provides at least two developing means.

2. Description of the Prior Art

A copy machine having plural developing units being settable thereinto has been well known. In such a copy machine, each developing unit provides a signal means for identifying a color of toner contained therein and, due to the signal means, each color of toner of respective developing units having been set in the copy machine can be detected. When a desired color is designated upon copying, a developing unit having the desired color of toner is automatically selected to develop an electrostatic latent image of a document formed on a photoconductive drum with the toner of desired color.

In such a multi-color copy machine having plural developing units, the black developing unit, namely the developing unit containing black toner is usually assigned to the standard one to be equipped in each copy machine since the probability in use of the black developing unit is assumed to be high. And the black developing unit is automatically designated in the initial state of the machine just after switching on the main switch or when the machine is automatically reset.

However, the copy machine in which the top priority is given to the black developing unit is not always convenient since there may be such a case that the red developing unit is used more frequently rather than the black developing unit. In fact, the red colored copy is desired rather than the black copy in the field of making leaflets.

If the copy machine wherein the top priority is given to the black developing unit is introduced to an office in which color copies of other than black are desired usually, miss copies will be increased since the black developing unit is usually designated. In such a case, the copy machine having the auto reset mode is rather inconvenient since an operator has to operate to switch the black developing unit to another developing unit of desired color upon copying.

SUMMARY OF THE INVENTION

One object of the present invention is to provide an image forming apparatus in which a developing unit having the highest probability in use is automatically selected among plural developing units.

Another object of the present invention is to provide an image forming apparatus in which a developing unit is automatically given the top priority according to needs of respective user.

In order to accomplish these objects, according to the present invention, there is provided an image forming apparatus having plural developing units which performs image forming operation with use of either one of the developing units further including means for counting respective number of times in use with respect to each of the plural developing units and means for selecting a developing unit having the largest number of times in use when a power source for the image forming apparatus is turned on.

If the copy machine has an entry means such as an operation panel for entering image forming conditions, it is also possible to select a developing unit having the largest number of times in use just after the power switch is switched on or when no image operation is started within a predetermined time period after said image forming conditions were entered.

The copy machine according to the present invention desirably provides means for counting respective number of times of image forming operation with respect to each color of the developer and the developing unit to be selected is determined in accordance with information given by said means.

BRIEF DESCRIPTION OF DRAWINGS

These and other objects and features of the present invention will become more apparent when the preferred embodiment of the present invention is described in detail with reference of accompanied drawings in that.

DESCRIPTION OF THE PREFERRED EMBODIMENT

In the preferred embodiment, the present invention is applied to a copy machine.

Figure 2:
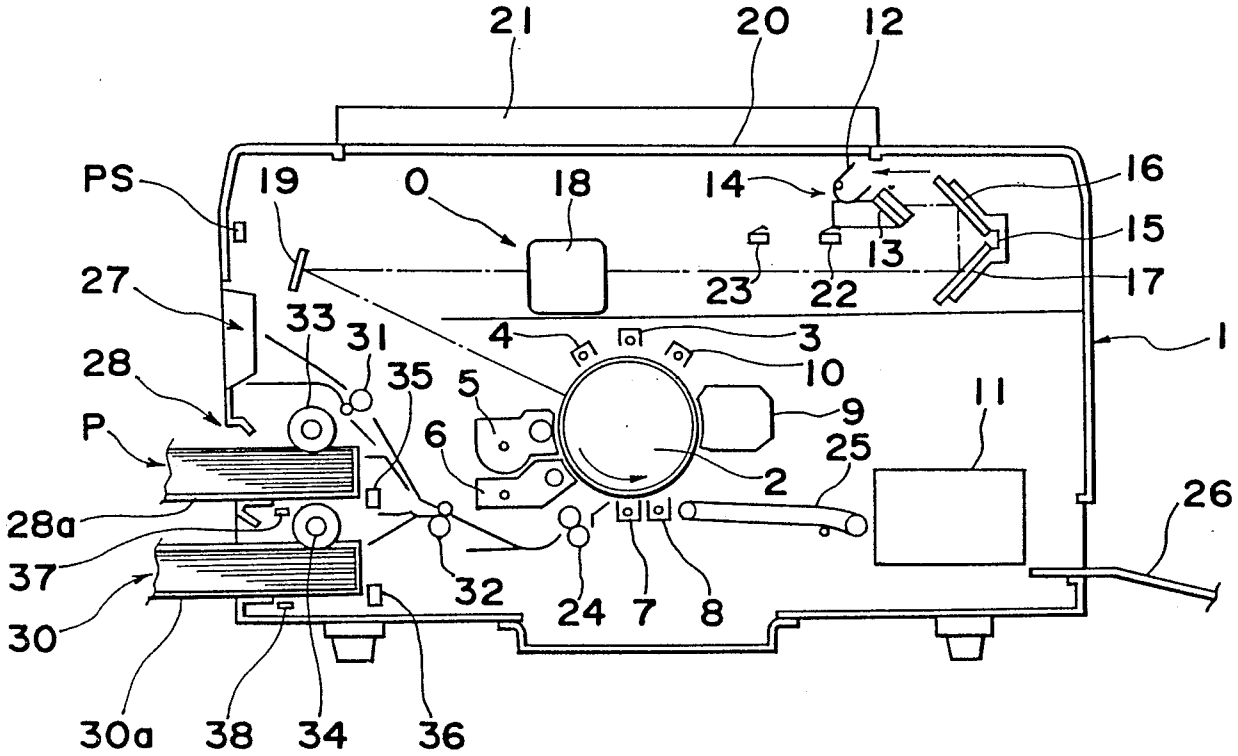
FIG. 2 is a schematic cross-sectional view of a copy machine according to the present invention.

As shown in FIG. 2, a photo-conductive drum 2 is supported rotatably in the center portion of a copy machine, which is driven to rotate in an anti-clockwise direction by a main motor (not shown). An electrifying charger (main charger) 3, an inter-image eraser 4 for erasing charges on a range of the drum where no document image is formed, upper and lower developing units 5, 6, a transferring charger 7, a separating charger 8, a cleaner 9 and a main eraser 10 are arranged around the drum 2 in a direction of rotation thereof. A scanning optical system O is arranged above the drum 2 and, on the left side thereof, a paper supplying system P is arranged. On the right side thereof, a fixing device 11 is arranged.

The copy machine 1 is connected to a power source when a power switch PS is switched on.

The scanning optical system O is comprised of a scanning unit 14 in which a light source 12 for illuminating a document through a slit and first movable mirror 13 are assembled, second and third mirrors 16 and 17 which are supported by a common holder 15, lens assembly 18 and a fixed mirror 19. A document to be copied is set on a glass platen 20 and covered by a document cover 21. A document scale (not shown) is arranged along an edge of the glass platen on the starting side of scan and a reference pattern (not shown) for detecting a density for developing is provided on the lower surface of the document scale.

When a scan is started by driving a scanning motor (not shown), an image of the reference pattern and a document image are exposed onto a range of the drum 2 which is electrified by the main charger 3 and, accordingly, latent images of the reference pattern and the document are formed on the drum 2.

The scanning velocity V of the scanning unit 14 is controlled at ($V_{0/m}$) assuming that the peripheral rotation speed of the drum 2 is equal to $V_0$ and a magnification of copy at that time is set at m, and the second and third mirrors 16 and 17 are moved at a velocity of ($V_{0/2m}$)

In order to detect positions of the scanning unit 14, a position switch 22 and a timing switch 23 are provided. The position switch 22 detects that the scanning unit 14 has returned to a predetermined standard position and outputs a signal indicating it to a control circuit of the copy machine (See FIG. 6). The timing switch 23 is arranged at a suitable position for detecting a timing when the scanning unit 14 moves by a predetermined distance from the starting position thereof and outputs a timing signal to the control circuit at that timing in order to drive a pair of timing rollers 24 for feeding a copy paper.

The latent image formed on the drum 2 is developed with toner which is supplied by either one of the first and second developing units 5 and 6. The formed toner image is transferred onto a copy paper fed by the pair of timing rollers 24 by energizing the transferring charger 7. The copy paper onto which the toner image is transferred is separated from the surface of the drum 2 by the separating charger 8. Then, the copy paper is conveyed to the fixing device 11 by a conveyer belt 25. The fixing device 11 fixes the toner image by heating and discharges the copy paper on a tray 26.

Toner remaining on the drum 2 is removed by the cleaner 9 and charge remaining thereon is erased by the main eraser 10 which is maintained to be turned on as far as the main motor is driven.

The density of the toner image of the reference pattern is measured with use of an LED (light emitting diode) and a photo-sensor (not shown) before removing remaining toner by the cleaner 9. The measured density is compared with a predetermined standard value. According to the result of the comparison, the amount of supply of toner by the first or second developing unit is controlled.

The paper supplying system P has a manual inserting means 27, first paper supplying unit 28 providing a cassette 28*a* and second paper supplying unit 30 providing a cassette 30*a*.

When a blank paper is inserted manually into the manual inserting means 27, it is fed by a roller 31 and an intermediate roller 32 to the pair of timing rollers 24. A blank paper contained in the first or second cassette 28*a* or 30*a* is fed by first or second feeding roller 33 or 34 and the intermediate roller 32 to the pair of timing rollers 24.

Each of rollers 24, 31, 32, 33 and 34 is engaged , via clutch means, disengageablly to a driving system (not shown) including the main motor. Accordingly, each roller is driven by the driving system when the corresponding clutch means is switched on. Paper size detection sensors 35 and 36 for detecting each size of blank papers contained in the cassette 28*a* and 30*a* and sensors 37 and 38 for detecting that respective cassettes become empty are arranged near the cassette 28*a* and 30*a*, respectively.

Figure 3:
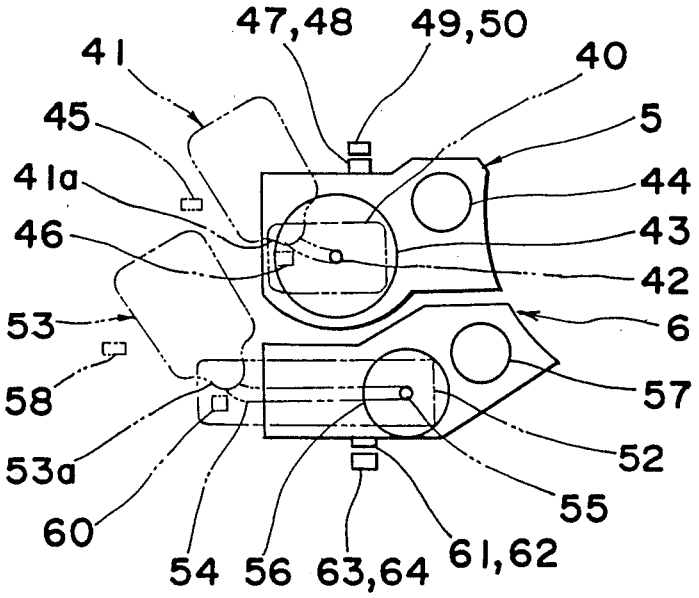
FIG. 3 is a schematic side view for showing developing units according to the preferred embodiment of the present invention.
Figure 4:
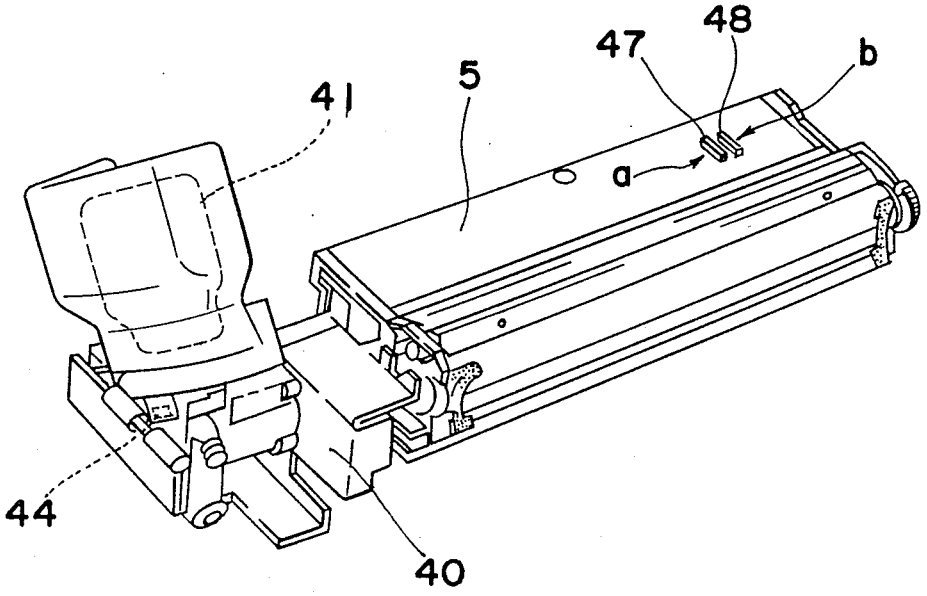
FIG. 4 is a perspective view of the developing unit.

FIG. 3 shows side elevational views of the upper and lower developing units 5 and 6 and FIG. 4 shows a perspective view of the former.

These developing units 5 and 6 are interchangeablly set in the copy machine. Though setting structures of them are not shown explicitly, those skilled in the art can easily understand those structures.

At first, the structure of the upper developing unit 5 is explained referring to FIG. 3 and FIG. 4.

A bracket 40 is fixed on an end in the length-wise direction of the upper developing unit 5. A toner replenishing bottle 41 for replenishing toner into the upper developing unit 5 is detachably mounted on the bracket 40. The toner replenishing mouth 41*a* of the bottle 41 is connected to an end of a toner transporting tube 42 extending in the upper developing unit 5 in the length-wise direction thereof.

The replenishing amount of toner from the toner replenishing bottle 41 is determined by controlling the number of revolutions of the bottle which is driven by a toner replenishing motor (not shown).

Namely, when the bottle 41 is rotated around the center axis thereof by the toner replenishing motor, the toner replenishing mouth 41*a* is opened and closed according to each rotation thereof and, accordingly, the replenishing amount of toner from the bottle 41 is controlled so as to be proportional to the number of revolutions of the toner. The latter is determined in accordance with the result of comparison of the measured density with the standard value as mentioned above. The toner replenished from the bottle 41 is supplied into the upper developing unit 5 through the transportation tube 42.

The toner supplied into the unit 5 is mixed with magnetic carrier beforehand contained in the unit 5 by rotating a bucket roller 43 with mixing blades. This bucket roller 43 is driven by a developing motor (not shown) which is mounted on the other end of the unit 5. The toner mixed with magnetic carrier is supplied to the surface of the drum by a developing sleeve 44 which is also driven to rotate by the developing motor. The latent image formed on the drum 2 is visualized by the supplied toner, while the magnetic carrier is collected into the unit and is used repeatedly. Besides, a bias voltage is applied to the developing sleeve from a power source therefor upon developing a latent image. If it is not applied thereto, the latent image is not developed by the developing unit even if the bucket roller 43 and the sleeve roller 44 are driven.

As is shown in FIG. 3, a bottle sensor 45 for detecting whether or not a toner replenishing bottle is mounted on the bracket 40 is arranged near the mount position thereof and a bottle empty sensor 46 for detecting an empty state of the bottle wherein toner has been consumed completely is arranged near the toner replenishing mouth 41*a* of the bottle mounted on the bracket 40. The bottle sensor 45 outputs a signal of high level as far as the bottle 41 is mounted on the bracket 40. Also, the bottle empty sensor 46 outputs a signal of high level as far as toner remains in the bottle. As shown in FIG. 4 clearly, two positions "a" and "b" are predetermined on the upper surface of the upper developing unit 5 in order to fix magnets for identifying a color of toner contained in the developing unit 5. In the example shown in FIG. 4, two magnets 47 and 48 are fixed at respective positions "a" and "b". Each existence of these magnets is detected by first and second reed switches 49 and 50 which are arranged above the positions "a" and "b", respectively, as shown in FIG. 3.

As shown in the following table, each toner color is identified from each combination of ON, OFF states of the first and second reed switches 49 and 50.

| First reed switch 49 | Second reed switch 50 | Toner color |
|---|---|---|
| ON | ON | Black |
| ON | OFF | Red |
| OFF | ON | Yellow |
| OFF | OFF | Blue |

On the other hand, the lower developing unit 6 provides similar structures to those of the upper developing unit 5. However, they are modified in order to arrange the lower developing unit 6 compactly under the upper one 5. Namely, a bracket 52 for mounting a toner replenishing bottle 53 is formed elongated rearwardly. Therefore, the toner replenishing bottle 53 can be mounted without interference with the upper developing unit 5. Further, magnets 61 and 62 are fixed at positions predetermined on the lower surface of the lower developing unit 6 and, accordingly, first and second reed switch 63 and 64 for detecting magnets 61 and 62 are arranged beneath the lower developing unit 6. Structures other than the mentioned above are substantially same to those of the upper developing unit 5. Namely, toner in the replenishing bottle 53 is supplied from the mouth 53*a* to a transporting tube 54 and the toner fed into the lower developing unit 6 through a transporting tube 55 is mixed with magnetic carrier according to rotation of a bucket roller 56 and the toner mixed with magnetic carrier is supplied to the surface of the drum 2 by a developing sleeve 57 when it is energized and rotated. A bottle sensor 58 and a bottle empty sensor 60 are also arranged near the replenishing bottle 53 and the mouth 53*a* thereof, respectively.

The lower developing unit 6 is used prior to the upper one 5 as the standard one. Namely, black toner is replenished thereinto in order to copy a document with black toner.

If the user wishes to copy with toner of another color, the upper developing unit 5 is designated. If the color of toner contained in the present upper developing unit 5 is different from the desired color, the present developing unit 5 is exchanged with another developing unit containing toner of the desired color.

It is to be noted that the term "developing unit" includes the replenishing bottle to be mounted thereon.

Upon forwarding a copy machine from a factory, the developing unit containing black toner is initially set so as to be selected prior to another developing unit in the initial state just after the main switch was switched on or when the copy machine is reset by the auto-reset timer. Once the copy machine has been settled in an office of an user, the color of toner to be selected prior to the other is determined or altered in accordance with respective frequency in use of each toner color.

Figure 5:
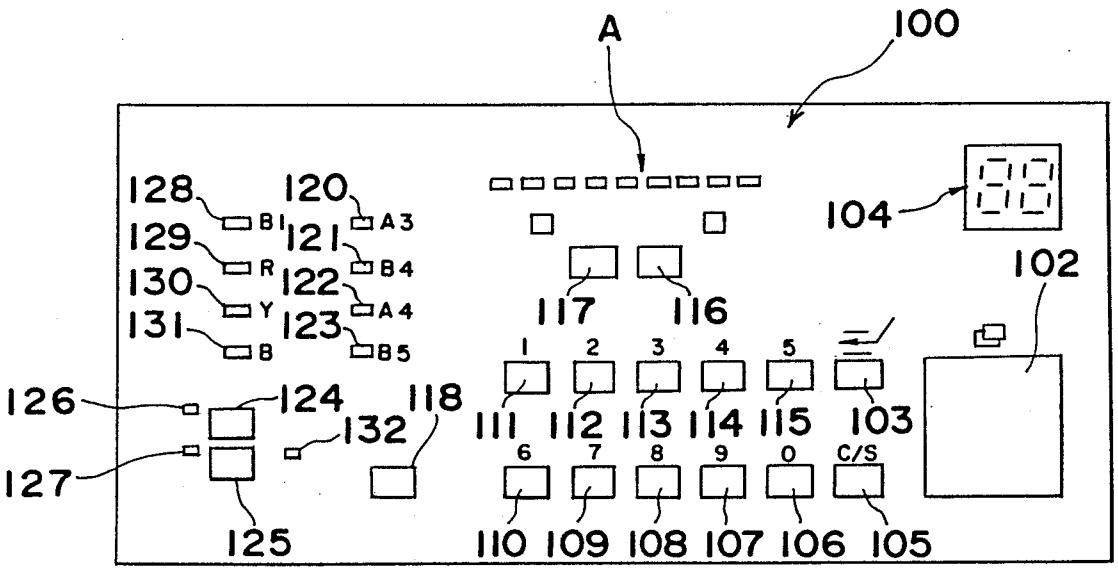
FIG. 5 is a plan view of an operational panel according to the preferred embodiment of the present invention.

FIG. 5 shows an operation panel 100 which is arranged on the upper front surface of the copy machine.

On the operation panel 100, the following elements are arranged:

a print key 102 for starting a copying operation; an interruption key 103; a digital display 104 for indicating the number of copies; a clear/stop key 105 for suspending a copy operation and for resetting the digital display 104; ten keys from 106 to 115 for setting the number of copies on the digital display 104;

an up key 116 and a down key 117 for increasing and decreasing the exposure amount by the light source, respectively;

a group A of LEDs for indicating the exposure amount selected presently;

a paper size selection key 118 for selecting or designating either one of the first and second paper supply units 28 and 30;

LEDs from 120 and 123 for indicating the paper size selected presently;

first and second developing unit selection keys 124 and 125 for selecting the upper and lower developing units 5 and 6, respectively;

two LEDs 126 and 127 for indicating the selected or designated developing unit 5 or 6, respectively;

four LEDs from 128 to 131 each for indicating respective color of toner contained in the selected developing unit; and one LED 132 for indicating that the bottle of the selected developing unit is empty.

The selected toner color is indicated by either one of LEDs 128 to 131 in the initial state just after switching on the power switch PS or in the state just after resetting the copy machine by the auto-reset timer.

Figure 6:
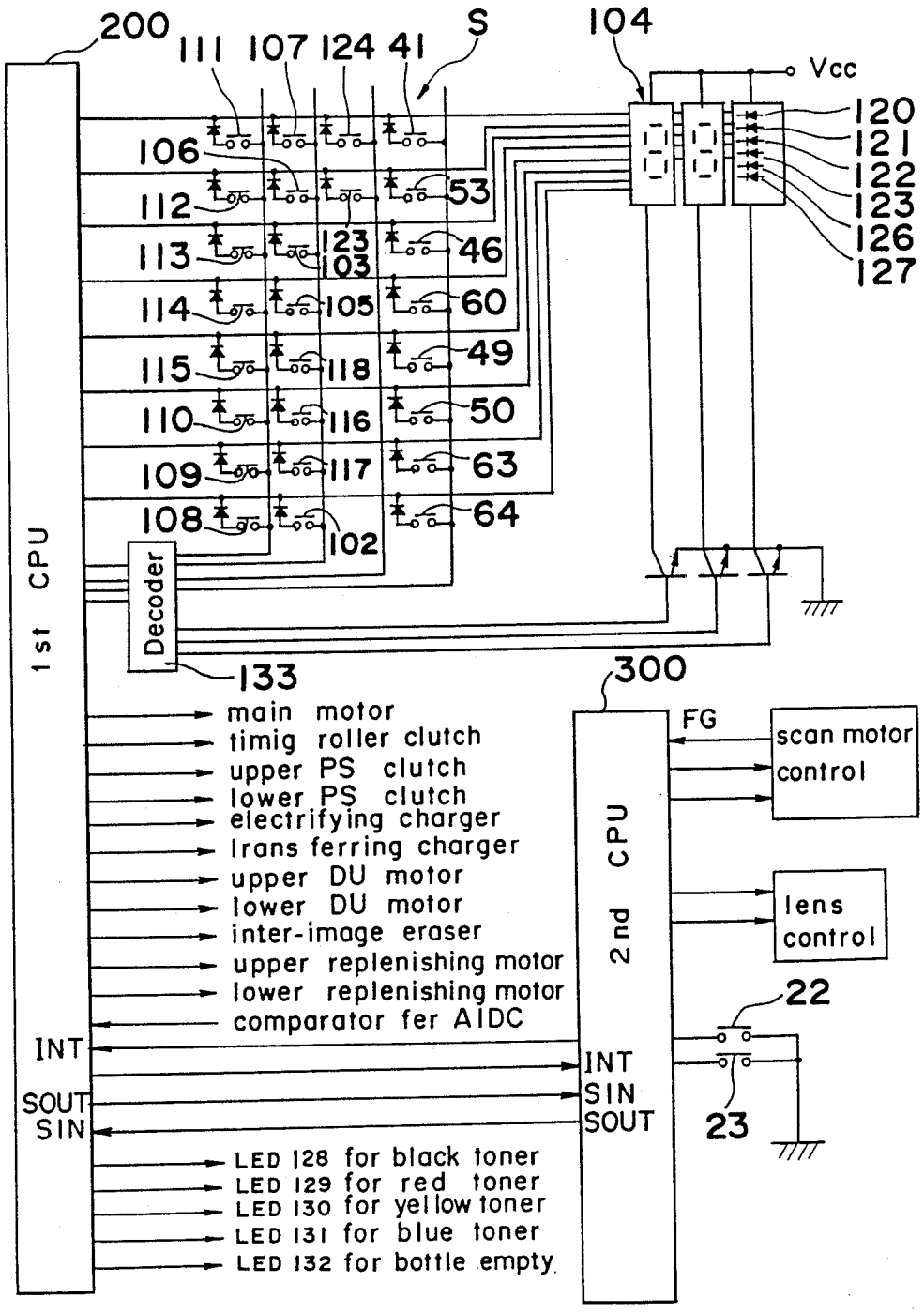
FIG. 6 is a block diagram showing control circuits for controlling the copy machine according to the present invention.

FIG. 6 shows a control circuit of the copy machine 1.

The control circuit includes first and second central processing units (CPUs) 200 and 300.

A switch matrix S is connected to the first CPU 200. The switch matrix S includes, as matrix elements, various keys on the operation panel, upper and lower bottle sensors 41 and 53, upper and lower bottle empty sensors 46 and 60, reed switches 49, 50, 63, 64 for identifying respective color of toner of each developing unit and the like. The first CPU 200 controls the main motor, various roller clutches and various LEDs in accordance with operations of individual keys and actions of individual sensors.

On the other hand, the second CPU 300 is provided for controlling the optical scanning system O. The standard position switch 22 and the timing switch 23 are connected to the second CPU 300. Further, the same is connected to the first CPU 200 with some signal lines in order to synchronize both of the first and second CPUs with each other.

Figure 7:
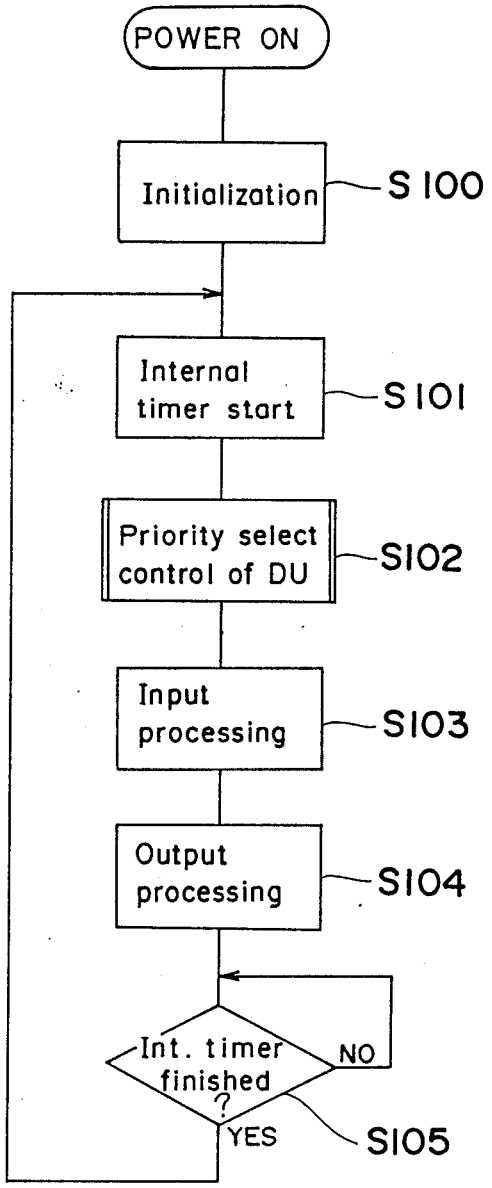
FIG. 7 is a flow chart of the main routine of the copy machine according to the present invention.

FIG. 7 shows a flow chart of the main routine to be executed by the first CPU 200.

When the power switch PS is switched on, an initializing subroutine is called and executed at step S100 to initialize various registers and timers. Then, at step S101, the internal timer initialized at step S100 is started. This internal timer is provided for making each processing time interval of individual subroutine even irrespective of contents thereof.

Next, a subroutine for priority selection control for the developing unit is called and executed at step S102. This subroutine will be stated later in detail since it is the subject matter of the present invention.

Next, various inputs from the operation panel 100 and output signals from individual sensors are accessed at step S103. Thereafter, a subroutine for output processing related to the copy operation is called and executed at step S104. Detail explanation of steps S103 and S104 is abbreviated since contents of them are well known to those skilled in the art.

Then, it is checked at step S105 if the internal timer is overflown or not and, if it is so, the process returns to step S101.

Figure 1A:
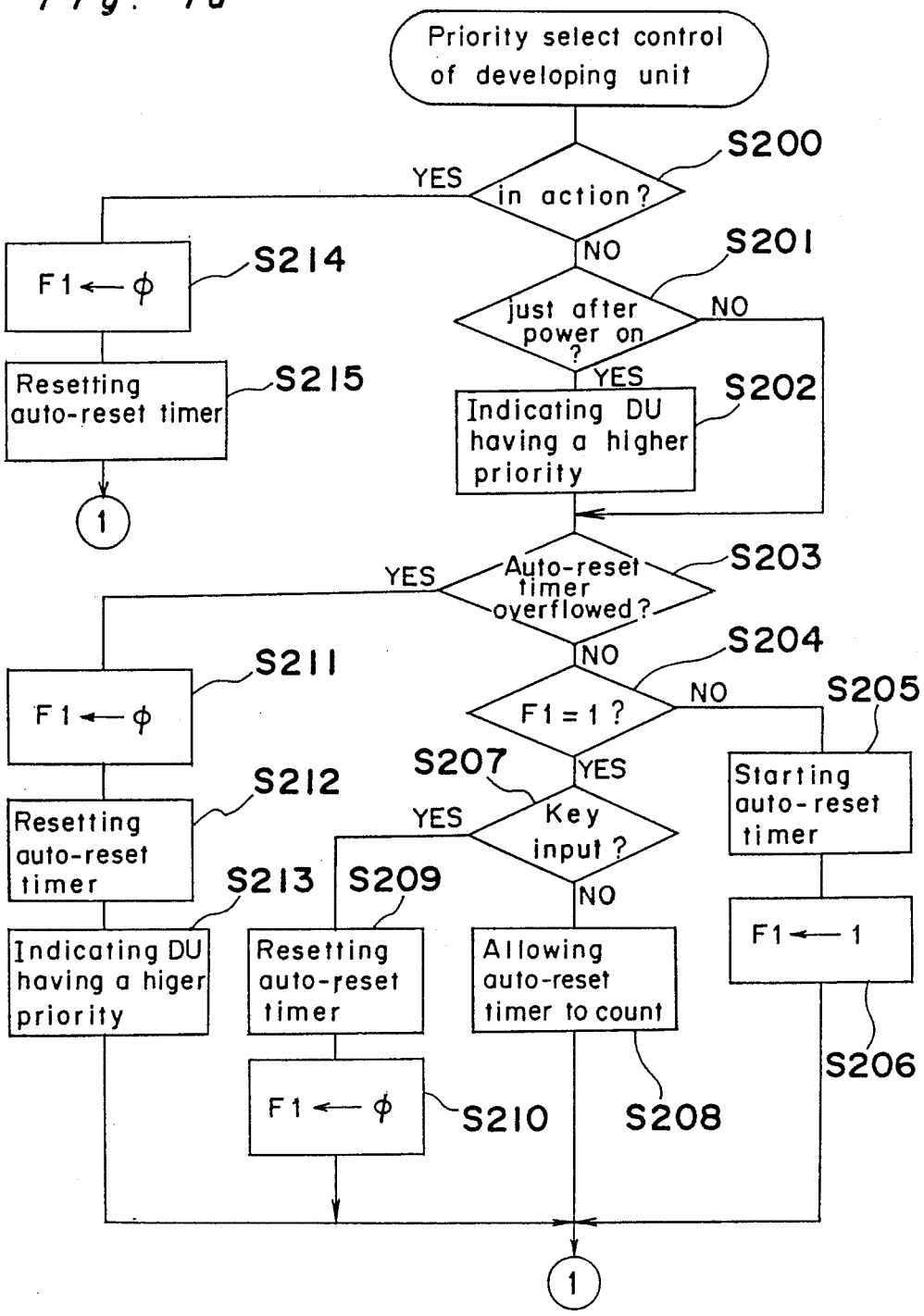
FIG. 1*a* and FIG. 1*b* show a flow chart of a routine for selecting a developing unit according to the present invention.
Figure 1B:
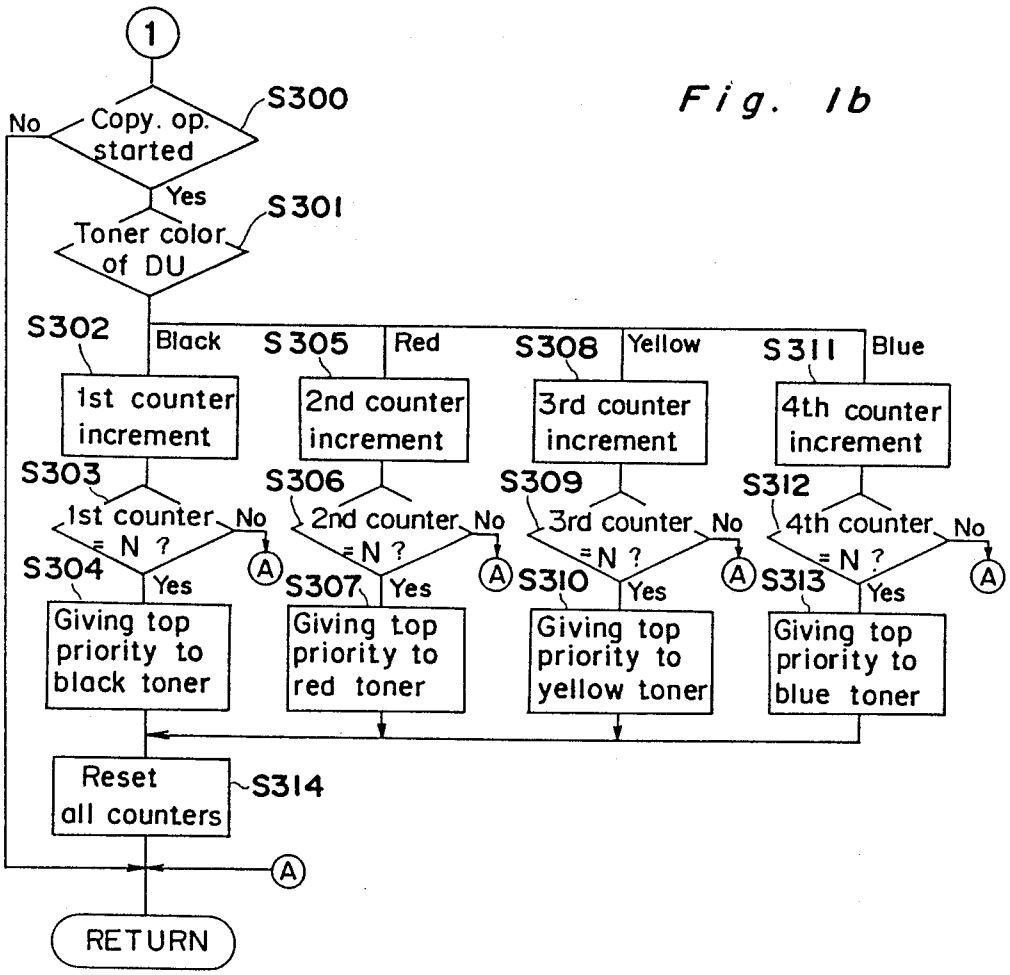

FIG. 1*a* and FIG. 1*b* show a flow chart of the subroutine for priority selection control of the developing unit.

Upon starting the explanation of the subroutine, it is to be noted that the color of toner of each of developing units having been set in the copy machine is identified in accordance with output signals from sensors 49, 50, 63 and 64.

At first, it is checked at step S200 whether or not the copy machine is in action to form an image of a document.

If it is NO at step S200, it is checked at step S201 whether or not the copy machine is in an initial state just after the power switch PS was switched on. If it is NO at step S201, the process is advanced to step S203. If it is YES, the process goes to step S202 to execute a processing for indicating or displaying a developing unit having a higher priority than the other. At step S203, it is checked whether or not a time period set by so called auto-reset timer is over.

The auto-reset timer is started after completion of an image forming operation and, when it is overflown, all displays on the operation panel 100 are initialized or reset to those in a predetermined priority mode. As is well known, the auto-reset operation is intended to avoid a miss copy by initializing the copy machine when a predetermined time is passed from the latest copy operation.

If it is NO at step S203, a flag F1 is checked at step S204. This flag F1 is a flag which is set when the auto-reset timer is started. Since it is "0" just after a copy operation, the process goes to step S205 to start the auto-reset timer. Then, the flag F1 is set at "1" at step S206 before advancing to step S300. If it is YES at step S204, the process goes to step S207 in order to check whether any key on the operation panel 100 is operated or not. If no key is operated, the process goes to step S208 to allow the auto-reset timer to count its time.

If either of keys is operated, the process goes to step S209 in order to reset the auto-reset timer and, then, the flag F1 is reset at "0" at S210. This is due to the reason that a copy preparation operation is assumed to be carried out by an operator when the key is operated. Namely, if the auto-reset timer is not reset, there is a possibility that the copy preparation operation is cancelled when the set time period has been over.

If the auto-reset timer overflowed at step S203, steps from S211 to S213 are executed in order to initialize indications on the operation panel 100. Namely, the flag F1 is reset at "0" at step S211, the auto-reset timer is reset at step S212 and the developing unit having a higher priority than the other is indicated or displayed on the operation panel 100 at step S213.

If the copy machine is in action at step S200, the flag F1 is reset at "0" at step S214 and, then, the auto-reset timer is reset at step S215 since it is not necessary to initialize indications on the operation panel 100. Thereafter, the process goes to step S300.

At step S300, it is checked whether a copy operation was started or not. If it is YES at step S300, the color of the developing unit designated presently is identified in accordance with output signals from the reed switches (49 and 50) or (63 and 64) at step S301. Then, the process goes to either one of steps S302, S305, S308 and S311 in accordance with the color of toner identified at step S301.

If the color of toner of the developing unit is identified to be black at step S301, first internal counter provided for counting the number of times in use with respect to the black toner is incremented by one at step S302. Similarly, if it is identified to be red, yellow or blue at step S301, second, third or fourth internal counter provided for counting the number of times in use with respect to each color toner is incremented by one at step S305, S308 or S311.

If the first internal counter is incremented, the count value thereof is compared with a predetermined number N at step S303. This number N is set, for example, at 100 in order to check which is the most frequently used toner color. If it does not come up to N, the present count value is written into a non-voltile RAM provided in the first CPU 200.

When the present count value comes up to N, data for giving the top priority with respect to the toner color is set to designate the black toner. Namely, the count value of the first internal counter comes up to N at first among the first to fourth internal counters, the black toner is given the top priority.

Similarly, if either one of the second to fourth internal counters comes up to N at first among four internal counters at step S306, S309 or S312, the toner color of the internal counter having come up to N at first is given the top priority at step S307, S310 or S313.

If either one of steps of S304, S307, S310 and S313 has been executed, the process goes to step S314. At step S314, all of the first to fourth internal counters are reset at "0", respectively.

As is apparent from the above, respective number of times in use with respect to each toner color is counted until either one of four counters comes up to N at first and thus, the toner color to which the top priority is given is renewed whenever either one of four counters comes up to N at first among them.

According to the present preferred embodiment of the present invention, the toner color being used most frequently in a time interval is always selected just after the power switch is turned on or the copy machine is automatically reset into the initial mode.

However, it is also possible to select the toner color having been given the top priority whenever an image forming operation has been completed.

Although the number of times in use is detected with respect to each toner color in the present embodiment, it can be calculated with respect to each of plural developing units. In such a case, the developing unit having the highest frequency in use is given the top priority. This can be easily realized by changing the flow of FIG. 1*b* so as to count the number of times in use with respect to the selected or designated developing unit.

Although only two developing units are disclosed in the present preferred embodiment, the present invention can be also applied to an image forming apparatus having three or more developing units.

Further, the present invention is applicable to various image forming apparatus other than a copy machine.

The preferred embodiments described herein are illustrative and not restrictive, the scope of the invention being indicated by the appended claims and all variations which come within the meanings of the claims are intended to be embraced herein.

What is claimed is:

1. An image forming apparatus having plural developing units which performs image forming operation with use of either one of the developing units further including:

means for counting respective number of times in use with respect to each of the plural developing units; and means for selecting the developing unit having the largest number of times in use when a power source for the image forming apparatus is turned on.

2. An image forming apparatus as claimed in claim 1, wherein the number of times in use is counted with respect to each developing unit by respective counters and, when either one of the counters comes up to a predetermined number first, the developing unit corresponding to the counter having counted said predetermined number at first is selected.

3. An image forming apparatus as claimed in claim 2, all of the counters are reset when either one of the counters comes up to said predetermined number at first.

4. An image forming apparatus having plural developing units which performs image forming operation with use of either one of the developing units further including:

means for counting respective number of times in use with respect to each of the plural developing units, and means for selecting the developing unit having the largest number of times in use after an image forming operation has been completed.

5. An image forming apparatus as claimed in claim 4, wherein the number of times in use is counted with respect to each developing unit by respective counters and, when either one of the counters comes up to a predetermined number first, the developing unit corresponding to the counter having counted said predetermined number at first is selected.

6. An image forming apparatus as claimed in claim 5, all of the counters are reset when either one of the counters comes up to said predetermined number at first.

7. An image forming apparatus having plural developing units which performs image forming operation with use of either one of the developing units further including:

means for counting respective number of times in use with respect to each of the plural developing units;

means for entering conditions for image forming; and means for selecting the developing unit having the largest number of times in use when no image forming operation is started within a predetermined time period after said conditions for image forming were entered.

8. An image forming apparatus as claimed in claim 7, wherein the number of times in use is counted with respect to each developing unit by respective counters and, when either on of the counters comes up to a predetermined number first, the developing unit corresponding to the counter having counted said predetermined number at first is selected.

9. An image forming apparatus as claimed in claim 8, all of the counters are reset when either one of the counters comes up to said predetermined number first.

10. An image forming apparatus having plural developing units in which developers of colors different from each other and which performs image forming operations with use of either one of the plural developing units further including:

means for detecting a color of the developer contained in the developing unit which is used presently;

means for counting respective number of times of image forming operation with respect to each color of the developer; and means for selecting a developing unit containing developer of the color with respect to which the number of times of image forming operation is maximum when a power source for the image forming apparatus is turned on.

11. An image forming apparatus as claimed in claim 10, wherein the number of times in use is counted with respect to color of developer contained in each developing unit by respective counter and, when either one of the counters comes up to a predetermined number first, the developing unit containing developer of the color corresponding to the counter having counted said predetermined number at first is selected.

12. An image forming apparatus as claimed, in claim 11, all of the counters are reset when either one of the counters comes up to said predetermined number first.

13. An image forming apparatus having plural developing units in which developers of colors different from each other and which performs image forming operations with use of either one of the plural developing units further including:

means for detecting a color of the developer contained in the developing unit which is used presently;

means for counting respective number of times of image forming operation with respect to each color of the developer;

means for entering conditions for image forming; and means for selecting a developing unit containing developer of the color with respect to which the number of times of image forming operation is maximum when no image forming operation is started within a predetermined time period after said conditions for image forming were entered.

14. An image forming apparatus as claimed in claim 13, wherein the number of times in use is counted with respect to color of developer contained in each developing unit by respective counter and, when either one of the counters comes up to a predetermined number first, the developing unit containing developer of the color corresponding to the counter having counted said predetermined number at first is selected.

15. An image forming apparatus as claimed in claim 14, all of the counters are reset when either one of the counters comes up to said predetermined number first.

16. In an image forming apparatus having plural developing units which performs image forming operation with use of either one of the developing units, a method comprising the steps of:

counting respective number of times in use with respect to each of the plural developing units; and selecting the developing unit having the largest number of times in use when a power source for the image forming apparatus is turned on.

17. In an image forming apparatus having plural developing units which performs image forming operation with use of either one of the developing, a method comprising the steps of:

counting respective number of times in use with respect to each of the plural developing units, and selecting the developing unit having the largest number of times in use after an image forming operation has been completed.

18. In an image forming apparatus having plural developing units which performs image forming operation with use of either one of the developing units, a method comprising the steps of:

counting respective number of times in use with respect to each of the plural developing units;

entering conditions for image forming; and selecting the developing units having the largest number of times in use when no image forming operation is started within a predetermined time period after said conditions for image forming were entered.

19. In an image forming apparatus having plural developing units in which developers of colors different from each other perform image forming operations with use of either one of the plural developing units, a method comprising the steps of:

detecting a color of the developer contained in the developing unit which is used presently;

counting respective number of times of image forming operation with respect to each color of the developer; and selecting a developing unit containing developer of the color with respect to which the number of times of image forming operation is maximum when a power source for the image forming apparatus is turned on.

20. An image forming apparatus having plural developing units in which developers of colors different from each other perform image forming operations with use of either one of the plural developing units, a method comprising the steps of:

detecting a color of the developer contained in the developing unit which is used presently;

counting respective number of times of image forming operation with respect to each color of the developer;

entering conditions for image forming; and selecting a developing unit containing developer of the color with respect to which the number of times of image forming operation is maximum when no image forming operation is started within a predetermined time period after said conditions for image forming were entered.

* * * * *